US006223764B1

(12) United States Patent
Charlesbois et al.

(10) Patent No.: US 6,223,764 B1
(45) Date of Patent: May 1, 2001

(54) HAND-HELD INFLATION VALVE ASSEMBLY

(76) Inventors: Todd Charlesbois, 1020 Swan River Rd., Bigfork, MT (US) 59911; Richard Hoinville, P.O. Box 1698, Columbia Falls, MT (US) 59912

( * ) Notice: Subject to any disclaimer, the term of this patent is extended or adjusted under 35 U.S.C. 154(b) by 0 days.

(21) Appl. No.: 09/307,250

(22) Filed: May 5, 1999

(51) Int. Cl.[7] ..... F16K 15/20
(52) U.S. Cl. ..... 137/231; 137/223
(58) Field of Search ..... 137/223, 231

(56) References Cited

U.S. PATENT DOCUMENTS

| | | | | |
|---|---|---|---|---|
| 1,637,499 | * | 8/1927 | Rundlett | 137/231 |
| 2,141,033 | * | 12/1938 | Crolwey | 137/231 |
| 2,964,002 | * | 12/1960 | Burton | 137/231 |
| 3,368,302 | * | 2/1968 | Martino | 137/223 |
| 3,476,136 | * | 11/1969 | Weisgerber | 137/231 |
| 3,786,994 | * | 1/1974 | Kukes et al. | 137/223 X |
| 3,933,177 | * | 1/1976 | Dwyer, Jr. | 137/223 X |
| 4,114,230 | * | 9/1978 | MacFarland | 137/223 X |
| 4,405,158 | * | 9/1983 | Huberman | 137/223 X |
| 5,305,784 | * | 4/1994 | Carter | 137/231 |
| 5,746,243 | * | 5/1998 | Franke | 137/231 |
| 5,785,076 | * | 7/1998 | You | 137/231 |
| 5,855,222 | * | 1/1999 | Jou | 137/223 |
| 5,862,843 | * | 1/1999 | Corbitt, III | 137/223 X |

FOREIGN PATENT DOCUMENTS

| | | | | |
|---|---|---|---|---|
| 625421 | * | 6/1949 | (GB) | 137/231 |

* cited by examiner

*Primary Examiner*—John Rivell
*Assistant Examiner*—Meredith H Schoenfeld
(74) *Attorney, Agent, or Firm*—Burkhart & Burkhart; Anne K. Burkhart; Patrick N. Burkhart

(57) ABSTRACT

An inflation valve assembly for temporarily connecting inflatable devices to sources of pressurized air is provided. The inflation valve assembly includes a valve coupling mechanism adapted for temporary connection to a source of pressurized air. An outlet nozzle is connected to the valve coupling mechanism. The outlet nozzle is adapted for relatively fluid-tight connection to a variety of inflatable devices. At least one grip member is secured between the valve coupling mechanism and the outlet nozzle. The grip member is adapted to orient the inflation valve assembly in a predetermined position when gripped by a user of the inflation valve assembly during inflation of an inflatable device. The valve coupling mechanism can be provided as a schrader valve. The outlet nozzle ca be configured as an annular frustoconical nozzle. The at least one grip member can be provided as a pair of grip members extending radially outwardly from the inflation valve assembly. In an embodiment, the grip members extend directly opposite to one another perpendicular to a longitudinal axis of the inflation valve assembly. The outer surfaces of the inflation valve assembly can be fabricated from a resilient material, such as neoprene. The outlet nozzle can include a plurality of adapter members constructed to coact with diverse inflatable devices.

20 Claims, 2 Drawing Sheets

HAND-HELD INFLATION VALVE ASSEMBLY

CROSS-REFERENCE TO RELATED APPLICATIONS

None

STATEMENT AS TO RIGHTS TO INVENTIONS MADE UNDER FEDERALLY-SPONSORED RESEARCH AND DEVELOPMENT

None

FIELD OF THE INVENTION

The invention relates generally to inflation devices. In particular, the invention relates to hand-held inflation valve assemblies for temporarily connecting inflatable devices to sources of pressurized-air.

DESCRIPTION OF RELATED ART

Anyone who has ever attempted to orally inflate a beach ball can attest the desirability of using a pressurized air source to fill inflatable devices. Dizzness and hyperventilation, compounded by wasted time, are the inevitable results of such endeavor.

Unfortunately, mechanical devices intended to replace respiratory inflation. themselves leave much to be desired. Manual pumps are often awkward or leaky. Electrically operated pumps are frequently provide air at such low volumes as to be useless. Not surprisingly, the automatic inflation of inflatable devices has been the subject of a high degree of inventive activity.

For example, U.S. Pat. No. 5,746,243 to Franke is directed to a valved inflation adapter for facilitating inflation of pneumatic objects. The inventive device includes an adapter body having a one-way valve assembly projecting therefrom which can be coupled to a conventionally known air chuck of a pressurized air source. The adapter body can be coupled with an inflation needle or an inflation cone to facilitate inflation of various pneumatic objects while precluding deflation of the object when the air chuck is not engaged with the valve assembly.

In another approach, U.S. Pat. No. 4,405,158 to Huberman discusses an air-filler adapter wherein an outer shell is adapted to fit various large diameter air supply hoses such as vacuum cleaner hoses, and a smaller diameter stem portion fits a variety of low pressure and medium pressure air filler openings used to inflate various inflatable consumer goods. The stem portion extends beyond the outer shell and has an outer tip which is adaptable to various air filler valves which are smaller than the vacuum cleaner hoses. The adapter comprises a pair of concentrically disposed tubes, the inner of which fits schrader air chucks on one end and fits the air filler openings for the consumer goods on the other end. The outer tube is sized to fit low-pressure pressurized air sources such as vacuum cleaner hoses and has an end wall which seals against the outside of the inner tube.

These devices represent a vast improvement over oral inflation and manual and electrical pumps. Unfortunately, they are still somewhat difficult to handle in use, and are relatively complex. It can be seen from the foregoing that the need exists for a simple, easy-to-use inflation valve assembly for temporarily connecting inflatable devices to sources of pressurized air.

SUMMARY

These and other objects are achieved by providing an inflation valve assembly for temporarily connecting inflatable devices to sources of pressurized air. The inflation valve assembly includes a valve coupling mechanism adapted for temporary connection to a source of pressurized air. An outlet nozzle is connected to the valve coupling mechanism. The outlet nozzle is adapted for relatively fluid-tight connection to a variety of inflatable devices. At least one grip member is secured between the valve coupling mechanism and the outlet nozzle. The grip member is adapted to orient the inflation valve assembly in a predetermined position when gripped by a user of the inflation valve assembly during inflation of an inflatable device.

The valve coupling mechanism can be provided as a schrader valve. The outlet nozzle can be configured as an annular frustoconical nozzle. The at least one grip member can be provided as a pair of grip members extending radially outwardly from the inflation valve assembly. In an embodiment, the grip members extend directly opposite to one another perpendicular to a longitudinal axis of the inflation valve assembly.

The outer surfaces of the inflation valve assembly can be fabricated from a resilient material, such as neoprene. The outlet nozzle can include a plurality of adapter members constructed to coact with diverse inflatable devices.

The features of the invention believed to be patentable are set forth with particularity in the appended claims. The invention itself, however, both as to organization and method of operation, together with further objects and advantages thereof, may be best understood by reference to the following description taken in conjunction with the accompanying drawings.

DETAILED DESCRIPTION OF A PREFERRED EMBODIMENT

Figure 1:
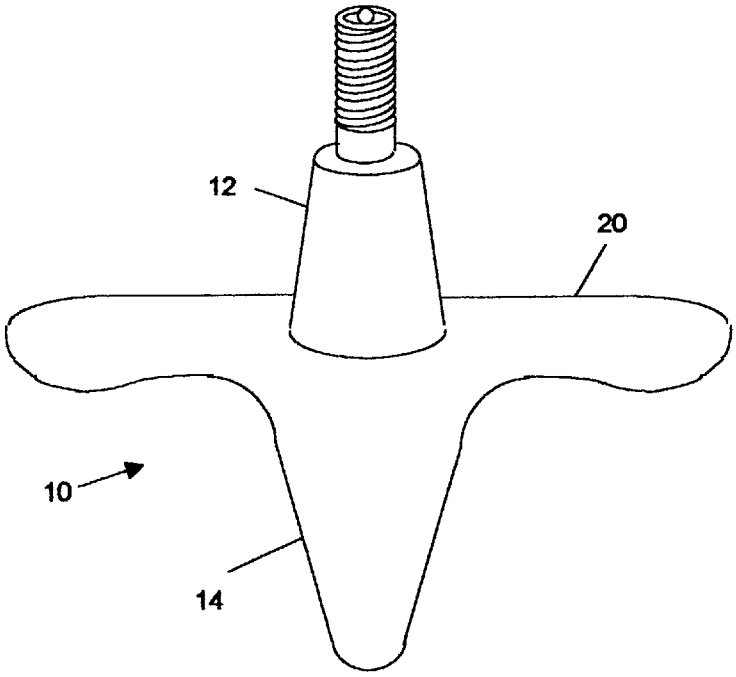
FIG. 1 is a schematic perspective view of an inflation valve assembly in accordance with the principles of the present invention.

While this invention is susceptible of embodiment in many different forms, there is shown in the drawings, and will herein be described in detail, exemplary embodiments, with the understanding that the present disclosure is to be considered as illustrative of the principles of the invention and not intended to limit the invention to the exemplary embodiments shown and described.

An inflation valve assembly 10 is illustrated generally in FIG. 1. The inflation valve assembly 10 includes a valve coupling mechanism 12 adapted for temporary connection to a source of pressurized air. The valve coupling mechanism 12 can be of any suitable type, and is shown as a well-known Schrader valve.

An outlet nozzle 14 is connected to the valve coupling mechanism 12. The outlet nozzle 14 is adapted for relatively fluid-tight connection to a variety of inflatable devices. The outlet nozzle 14 can be configured in any suitable shape, for example, as an annular frustoconical nozzle.

Figure 2:
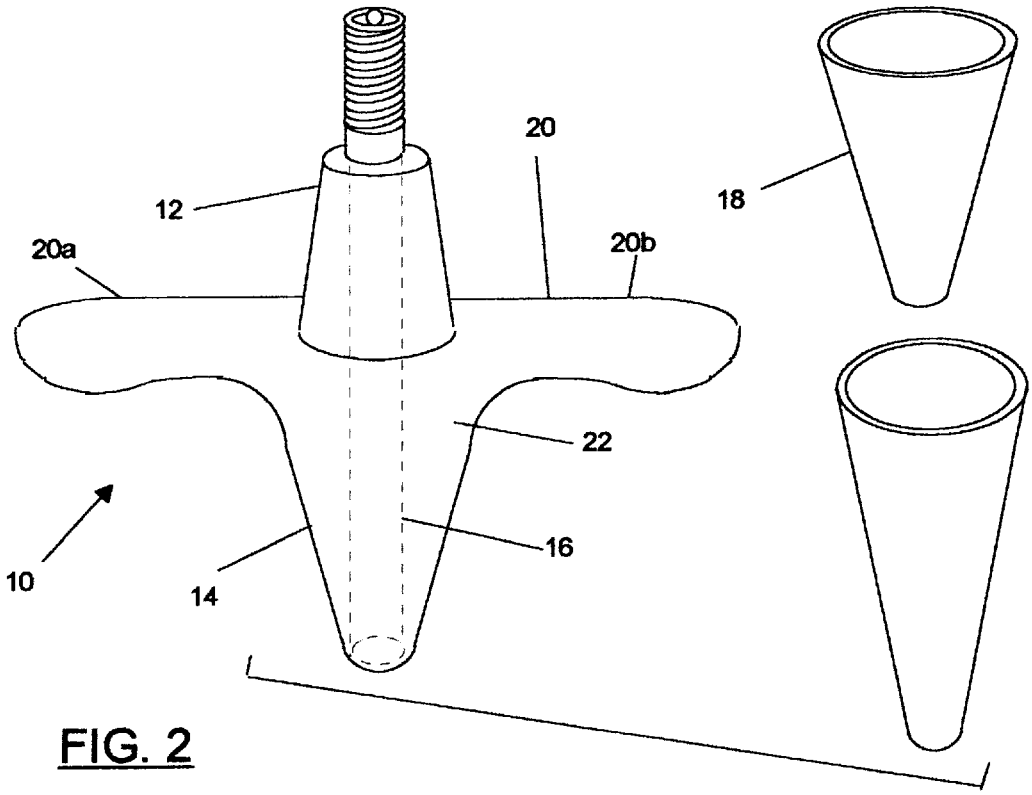
FIG. 2 schematically illustrates a perspective view, partially broken away, of the FIG. 1 inflation valve assembly.

As shown in FIG. 2, the outlet nozzle 14 is in direct fluid communication with the valve coupling mechanism 12 via an internal conduit 16. The outlet nozzle 14 can include a plurality of adapter members 18 constructed to coact with diverse inflatable devices.

At least one grip member 20 is secured between the valve coupling mechanism 12 and the outlet nozzle 14. The grip member 20 is adapted to orient the inflation valve assembly 10 in a predetermined position when gripped by a user of the inflation valve assembly 10 during inflation of an inflatable device.

The at least one grip member 20 can be provided as a pair of grip members 20*a*, 20*b* extending radially outwardly from the inflation valve assembly 10. The grip members 20*a*, 20*b* extend directly opposite to one another perpendicular to a longitudinal axis A of the inflation valve assembly 10.

The outer surfaces 22 of the inflation valve assembly 10 can be fabricated from a resilient material, such as neoprene.

Figure 3:
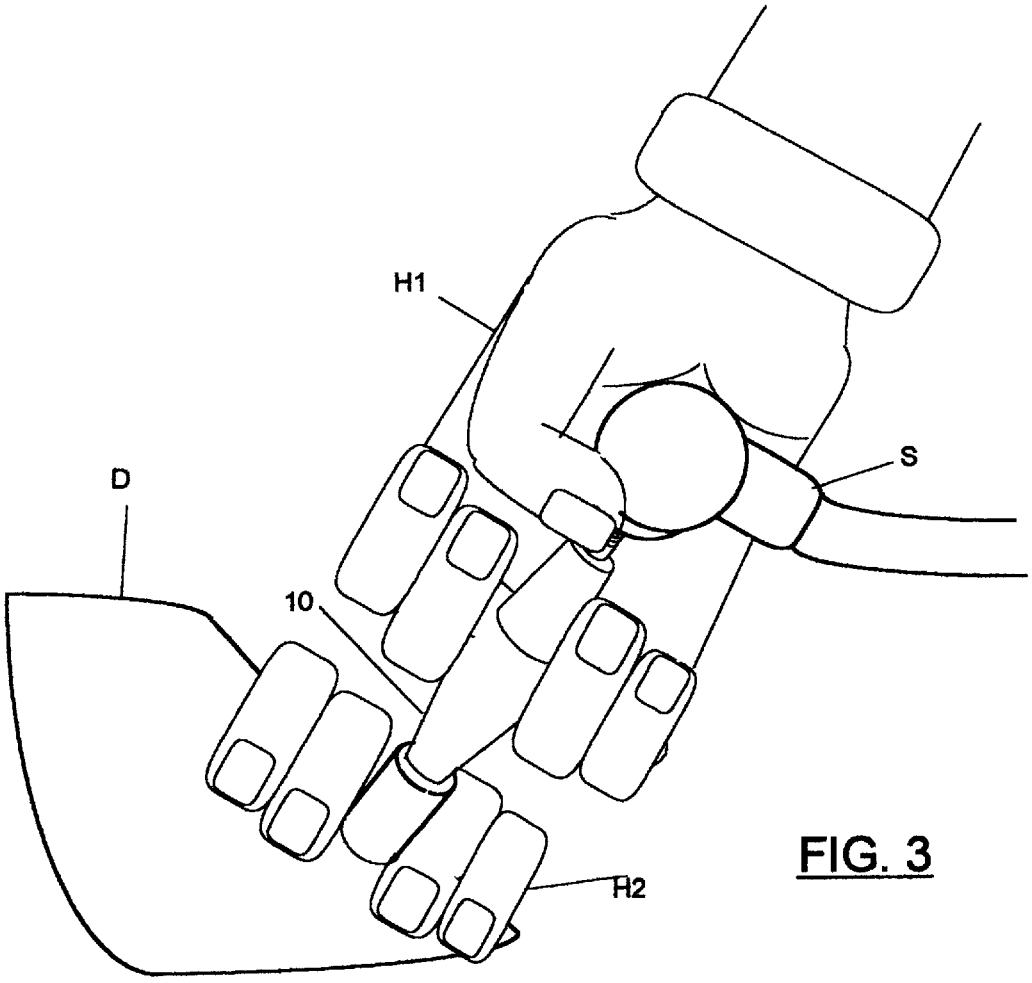
FIG. 3 illustrates a schematic perspective view of an inflation valve assembly in use.

As illustrated in FIG. 3, operation of the valve assembly 10 is begun by grasping the grip members 20*a*, 20*b* in a first hand H1 to orient the inflation valve assembly 10 in a predetermined position. Next, the valve coupling mechanism 12 is connected to a source of pressurized air S, such as a typical service station air hose. The outlet nozzle 14 is connected to an inflatable device D using a second hand H2. The valve coupling mechanism is then squeezed, using the first hand, into the source S to allow air to flow through the valve assembly 10, thus inflating the device D.

While details of the invention are discussed herein with reference to some specific examples to which the principles of the present invention can be applied, the applicability of the invention to other devices and equivalent components thereof will become readily apparent to those of skill in the art. For example, it is contemplated that the present invention may find utility with sources of other pressurized fluids to fill diverse fluid-fillable devices, such as helium balloons or water beds.

Accordingly it is intended that all such alternatives, modifications, permutations, and variations to the exemplary embodiments can be made without departing from the scope and spirit of the present invention.

We claim:

1. An inflation valve assembly for temporarily connecting inflatable devices to sources of pressurized air, the inflation valve assembly comprising the following:

a valved coupling mechanism adapted for temporary connection to a source of pressurized air;

an outlet nozzle connected to the valve coupling mechanism, the outlet nozzle being adapted for relatively fluid-tight connection to a variety of inflatable devices; and at least one grip member between the valve coupling mechanism and the outlet nozzle, the grip member being adapted to orient the inflation valve assembly in a predetermined position with respect to the source of pressurized air and to maintain fluid-tight connection between the valve coupling mechanism and the source of pressurized air when gripped by a user of the inflation valve assembly during inflation of an inflatable device.

2. An inflation valve assembly according to claim 1, wherein the valve coupling mechanism comprises a schrader valve.

3. An inflation valve assembly according to claim 1, wherein the outlet nozzle comprises an annular frustoconical nozzle.

4. An inflation valve assembly according to claim 1, wherein the at least one grip member comprises a pair of grip members extending radially outwardly from the inflation valve assembly.

5. An inflation valve assembly according to claim 4, wherein the grip members extend directly opposite to one another perpendicular to a longitudinal axis of the inflation valve assembly.

6. An inflation valve assembly according to claim 1, wherein the outer surfaces of the inflation valve assembly are fabricated from resilient material.

7. An inflation valve assembly according to claim 6, wherein the outer surfaces of inflation valve assembly are fabricated from neoprene.

8. An inflation valve assembly according to claim 1, wherein the outlet nozzle comprises a plurality of adapter members constructed to coact with diverse inflatable devices.

9. A valve for assembly temporarily connecting fluid-fillable devices sources of pressurized fluid, the valve assembly comprising the following:

a valved coupling mechanism adapted for temporary connection to a source of pressurized fluid;

an outlet nozzle connected to the valve coupling mechanism, the outlet nozzle being adapted for relatively fluid-tight connection to a variety of fluid-fillable devices; and at least one grip member between the valve coupling mechanism and the outlet nozzle, the grip member being adapted to orient the valve assembly in a predetermined position with respect to the source of pressurized air and to maintain fluid-tight connection between the valve coupling mechanism and the source of pressurized air when gripped by a user of the valve assembly during filling of a fluid-fillable device.

10. A valve assembly according to claim 9, wherein the outlet nozzle comprises an annular frustoconical nozzle.

11. A valve assembly according to claim 9, wherein the at least one grip member comprises a pair of grip members extending radially outwardly from the valve assembly.

12. A valve assembly according to claim 11, wherein the grip members extend directly opposite to one another perpendicular to a longitudinal axis of the valve assembly.

13. A valve assembly according to claim 9, wherein the outer surfaces of the valve assembly are fabricated from resilient material.

14. A valve assembly according to claim 13, wherein the outer surfaces of valve assembly are fabricated from neoprene.

15. A valve assembly according to claim 9, wherein the outlet nozzle comprises a plurality of adapter members constructed to coact with diverse fluid-fillable devices.

16. A valve assembly according to claim 9, wherein the valve coupling mechanism comprises an air valve.

17. A valve assembly according to claim 16, wherein the valve coupling mechanism comprises a schrader valve.

18. A method for temporarily connecting inflatable devices to sources of pressurized air, the method comprising the following steps:

providing an inflation valve assembly including a valved coupling mechanism adapted for temporary connection to a source of pressurized air, an outlet nozzle connected to the valve coupling mechanism, the outlet nozzle being adapted for relatively fluid-tight connection to a variety of inflatable devices, and at least one grip member between the valve coupling mechanism and the outlet nozzle;

grasping the grip member in a first hand to orient the inflation valve assembly in a predetermined position with respect to the source of pressurized air and to establish and maintain a connection between the valve coupling mechanism and the source of pressurized air;

connecting the valve coupling mechanism to a source of pressurized air; connecting the outlet nozzle to an inflatable devices using a second hand; and actuating the valve coupling mechanism, using the first hand, to inflate the inflatable device.

19. A valve assembly according to claim 18, wherein the step providing an inflation valve assembly comprises providing the at least one grip member as a pair of grip members extending radially outwardly from the valve assembly directly opposite to one another perpendicular to a longitudinal axis of the valve assembly.

20. A valve assembly according to claim 18, wherein the step of providing an inflation valve assembly comprises providing the valve assembly with outer surfaces fabricated from neoprene.

* * * * *

UNITED STATES PATENT AND TRADEMARK OFFICE

CERTIFICATE OF CORRECTION

PATENT NO. : 6,223,764 B1
DATED : May 1, 2001
INVENTOR(S) : Todd Charlestois, Richard Hoinville It is certified that error appears in the above-identified patent and that said Letters Patent is hereby corrected as shown below:

Column 1,
Line 22, delete "attest the" and insert -- attest to the -- in its place.
Line 26, delete "inflation." and insert -- inflation -- in its place.

Column 4,
Line 13, delete "Avalve for assembly temporarily connecting" and insert
-- __A valve assembly for temporarily connecting --
Line 14, delete "devices sources" and insert -- devices to sources -- in its place.

Signed and Sealed this

Thirtieth Day of October, 2001

*Attest:*

Nicholas P. Godici

*Attesting Officer*

NICHOLAS P. GODICI
*Acting Director of the United States Patent and Trademark Office*